US010539143B2

(12) United States Patent
Blad

(10) Patent No.: US 10,539,143 B2
(45) Date of Patent: Jan. 21, 2020

(54) CENTRIFUGAL PUMP HAVING AXIALLY MOVEABLE IMPELLER WHEEL FOR CONVEYING DIFFERENT FLOW PATHS

(71) Applicant: GRUNDFOS HOLDING A/S, Bjerringbro (DK)

(72) Inventor: Thomas Blad, Bjerringbro (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 922 days.

(21) Appl. No.: 14/392,325

(22) PCT Filed: Jun. 25, 2014

(86) PCT No.: PCT/EP2014/063371
§ 371 (c)(1),
(2) Date: Dec. 24, 2015

(87) PCT Pub. No.: WO2014/207031
PCT Pub. Date: Dec. 31, 2014

(65) Prior Publication Data

US 2016/0273543 A1 Sep. 22, 2016

(30) Foreign Application Priority Data

Jun. 27, 2013 (EP) ..... 13174144

(51) Int. Cl.
*F04D 29/042* (2006.01)
*F04D 15/00* (2006.01)
(Continued)

(52) U.S. Cl.
CPC ..... *F04D 29/042* (2013.01); *F04D 13/0606* (2013.01); *F04D 15/0016* (2013.01); *F04D 29/426* (2013.01); *F24D 2220/0207* (2013.01)

(58) Field of Classification Search
CPC .. F04D 29/042; F04D 29/426; F04D 29/0416; F04D 29/46; F04D 29/466;
(Continued)

(56) References Cited

U.S. PATENT DOCUMENTS 2,265,806 A 12/1941 Goldschmied
2,660,366 A * 11/1953 Klein ..... F04D 27/0215 415/118
(Continued)

FOREIGN PATENT DOCUMENTS

DE 15 28 798 A1 9/1969
DE 21 07 000 A1 8/1972
(Continued)

OTHER PUBLICATIONS

Translation of DE 2107000 A1.*

*Primary Examiner* — Dwayne J White
*Assistant Examiner* — Danielle M. Christensen
(74) *Attorney, Agent, or Firm* — McGlew and Tuttle, P.C.

(57) ABSTRACT

A pump assembly (2) includes an electric drive motor (14) and with at least one impeller (18) which is driven by the motor. The impeller is movable in an axial direction (X) between at least one first and one second position. The impeller in the first axial position is situated in a first flow path through the pump assembly and delivers a fluid through this first flow path. The impeller in the second position is situated in a second flow path through the pump assembly and delivers a fluid through this second flow path. The pump assembly (2) is configured such that a movement of the impeller (18), between the first and the second position at least in one direction, is effected by a hydraulic force which acts on the impeller (18) and is produced by the delivered fluid. A heating installation is provided with such a pump assembly.

25 Claims, 3 Drawing Sheets

(51) Int. Cl.
*F04D 13/06* (2006.01)
*F04D 29/42* (2006.01)

(58) Field of Classification Search
CPC ..... F04D 29/462; F04D 15/0038; F04D 15/0022; F04D 15/0027; F04D 1/00; F04D 13/064; F04D 13/024; F04D 13/0606; F24D 2220/0207
See application file for complete search history.

(56) References Cited

U.S. PATENT DOCUMENTS

| | | | | | |
|---|---|---|---|---|---|
| 3,162,128 | A | * | 12/1964 | Horlen | F04D 15/0072 415/131 |
| 3,723,019 | A | * | 3/1973 | Berman | F04D 15/0011 415/143 |
| 4,392,777 | A | | 7/1983 | Huettlin | |
| 5,346,458 | A | | 9/1994 | Affeld | |
| 6,638,031 | B1 | | 10/2003 | Humburg | |

FOREIGN PATENT DOCUMENTS

| | | | | | |
|---|---|---|---|---|---|
| DE | 2107000 | A1 | * | 8/1972 | F04D 15/0016 |
| DE | 30 02 210 | A1 | | 7/1981 | |
| DE | 4020120 | A1 | | 1/1991 | |
| DE | 195 23 661 | A1 | | 1/1997 | |
| DE | 100 06 396 | A1 | | 11/2000 | |
| DE | 101 15 989 | A1 | | 12/2001 | |
| EP | 2 228 891 | A2 | | 9/2010 | |
| JP | 2006 214348 | A | | 8/2006 | |
| JP | 4645210 | B2 | | 3/2011 | |

* cited by examiner

CENTRIFUGAL PUMP HAVING AXIALLY MOVEABLE IMPELLER WHEEL FOR CONVEYING DIFFERENT FLOW PATHS

CROSS REFERENCE TO RELATED APPLICATIONS

This application is a United States National Phase Application of International Application PCT/EP2014/063371 filed Jun. 25, 2014 and claims the benefit of priority under 35 U.S.C. § 119 of European Patent Application 13174144.9 filed Jun. 27, 2013 the entire contents of which are incorporated herein by reference.

FIELD OF THE INVENTION

The invention relates to a pump assembly with an electric drive motor and with at least one impeller which is driven by the motor, wherein the impeller is movable in the axial direction between at least one first and a second position.

BACKGROUND OF THE INVENTION

A centrifugal pump assembly is known from DE 101 15 989 A1, with which a rotor shaft is axially displaceable together with the impeller, so that the impeller can be moved into a position, in which its peripheral exit openings are closed. In this manner, the pump assembly can assume a valve function and block a flow passage.

Moreover, a pump assembly with two impellers which are driven via a common shaft is known from DE 30 02 210 A1. By way of axial movement of the shaft, these impellers can be displaced in the axial direction in each case between two exit channels, so that the impellers either deliver water from a primary circuit into a secondary circuit and back, or however only separately in the primary circuit and in the secondary circuit, depending on the axial position of the shaft. Thereby, a displacement device which is to be actuated hydraulically or pneumatically and which is arranged outside the pump assembly is provided for axial displacement of the shaft. Such a displacement device has the disadvantage that the shaft must be led out of the inside of the pump housing, so that a sealed feed-through must be provided.

SUMMARY OF THE INVENTION

It is an object of the invention, to provide an improved pump assembly, as well as a heating installation with such a pump assembly, which, with a simple construction of the pump assembly, permits a fluid to be delivered selectively through at least two flow paths.

The pump assembly according to the invention comprises an electric drive motor, in particular a wet-running electronic drive motor, i.e. a canned motor, with which the stator is separated from the rotor space by a can. The pump assembly is designed as a centrifugal pump assembly and comprises at least one impeller which is rotatingly driven by the electric drive motor. For this, the impeller can be connected via a shaft to the rotor of the electric drive motor. However, it is also possible for the rotor and the shaft to form an integral component and for the impeller to be connected to this component. The impeller can also be designed integrally with the rotor and/or the shaft.

The impeller is arranged or mounted such that in the axial direction it can be moved between at least two positions, i.e. operating positions, in which it can be rotatingly driven by the drive motor. Thereby, the pump assembly is designed such that in a first of these two positions, the impeller is arranged such that it is situated in a first flow path through the pump assembly and delivers fluid through this first flow path on rotation. The second position or the operating position is a position, in which the impeller is situated in a second flow path which runs through the pump assembly, and on rotation, i.e. on operation of the pump assembly, delivers fluid through this second flow path. This means that by way of axial movement of the impeller along its rotation axis or longitudinal axis, it is possible to move the impeller between two operating positions, i.e. the mentioned first position and the mentioned second position, in order to selectively deliver fluid through a first or through a second flow path, depending on the position, in which the impeller is situated. It is also conceivable for the impeller to be able to assume one or more intermediate positions between the mentioned first and the mentioned second position, in which it delivers fluid in shares, through both of the at least two flow paths.

The envisaged axial movement of the impeller is preferably selected so high that the cross-sectional area of the entry opening of the impeller is so large in each position of the impeller, that a certain maximal flow speed is not exceeded. Preferably, the pump assembly is designed such that the entry opening into the impeller, in particular a radial-side entry opening into the impeller, as is described below, has an area which is in the region of 50 to 150% of the inner cross-sectional area of the impeller at its suction side. This inner cross-sectional area extends transversely to the longitudinal axis or iolalion axis of the impeller.

According to the invention, the pump assembly is thereby designed such that at least in one movement direction of the impeller, this movement is effected by a hydraulic force which is caused itself by the fluid which is delivered by the impeller. I.e. the pump assembly is designed such that the pressure of the fluid delivered by the impeller acts on a suitable surface such that a hydraulic force which is directed in the axial direction, i.e. parallel to the rotation axis of the impeller and which is used in order to axially displace the impeller in this direction, is produced on this surface. The use of the hydraulic force for displacing the impeller has the advantage that one can make do without external actuation devices and the force required for displacement in contrast can be produced by the pump assembly, i.e. by the rotating impeller itself. This has the particular advantage that it is not necessary to lead the shaft or the rotor out of the sealed interior of the pump assembly to the outside, in order to be coupled there to an actuation device for the axial displacement. Preferably, as with common canned motors, the complete rotor can be arranged in the inside of the can in a sealingly encapsulated manner.

Moreover, the pump assembly is preferably designed such that the impeller on operation, i.e. when it is rotatingly driven by the drive motor, is held by at least one hydraulic force produced by the delivered fluid, in at least one of the positions, i.e. in the first or the second position. For this, the fluid pressure produced by the impeller can act on a corresponding pressure surface (pressing surface) which is connected to the impeller or is coupled for force transmission, so that a force is exerted on the pressure surface, and this force presses the impeller into the desired position or holds it in this position. The force is directed preferably parallel to the rotation axis of the impeller. I.e. the mentioned pressure surface preferably has an alignment transverse to this rotation axis or at least a component directed transversely to the rotation axis.

Further preferably, the pump assembly is designed such that the impeller on operation is held in at least one of the positions, i.e. the mentioned first or second position, by an interaction of at least one hydraulic force produced by the delivered fluid, of a spring force and/or of an axially acting magnetic force, wherein the magnetic force further preferably acts on a rotor of the drive motor which is connected to the impeller. Particularly preferably, the impeller is held by the magnetic force in one of the two mentioned positions, wherein in this condition, the magnetic force is larger than a hydraulic force acting on the impeller in the opposite direction. Alternatively or additionally to the magnetic force, a spring force produced by a spring element can act on the impeller such that it is held in one of the positions. A hydraulic force then acts on the impeller in the second position, for example on a pressure surface aligned in the manner described above, and this force is greater than the magnetic force and/or the spring force, so that the impeller is held in the second position against the magnetic force and/or the spring force. I.e. the impeller by way of interaction of a magnetic force and/or a spring force and a hydraulic force can be selectively held in the first or in the second position, wherein in one of the positions, the hydraulic force and in the other position the magnetic force or spring force is greater. In order to achieve a switch-over between the positions, accordingly one of the forces must be increased and/or the other force accordingly reduced. Since the hydraulic force is preferably produced by the impeller itself when it rotates, this force on standstill of the pump assembly does not act, so that in this condition it is preferably then only a magnetic force and/or a spring force which acts on the impeller. The impeller in the idle condition can be moved in this manner by the magnetic force and/or the spring force into a defined one of the two positions, so that the impeller in the idle condition of the pump assembly is always situated in a defined one of the two possible positions. I.e. on running up, the pump assembly always starts departing from a defined position.

According to a further preferred embodiment, the pump assembly can also be designed in a manner such that an axially acting magnetic force is produced by subjecting the drive motor to current, and this force can be produced for example by way of interaction between the rotor and the stator of the drive motor. Such a magnetic force can also move the impeller from an idle position, which represents a first position, in the axial direction into a second position. In the first position, the impeller can for example also be held by a magnetic force and/or a spring force. Such a magnetic axial force occurring on operation of the drive motor, as the case may be, with a suitable design of the pump assembly, can be supported by the previously described hydraulic axial force produced by the impeller itself.

The impeller is preferably connected to a rotor of the electric drive motor, and at least one magnetic force, in particular the previously described magnetic force acting on the impeller in the axial direction, results preferably from a magnetic interaction between the rotor and a surrounding stator, in particular from an axial shift between the rotor and stator. For example, if the rotor is designed as a permanent magnet rotor and is situated in a stator comprising iron element and coils, the rotor strives to center itself in the axial direction magnetically in the inside of the iron part of the stator. If the rotor is moved in the axial direction, out of this centered position, an axial magnetic restoring force acting counter to this movement results. This force can be used as a magnetic force in the axial direction for moving the rotor and an impeller connected thereto, between the two mentioned positions and/or for holding the impeller in one of these positions. Thus, the pump assembly can be designed such that on operation of the pump, a pressure of the delivered fluid acts on the impeller in the axial direction, at least in certain operating conditions, in a manner such that a hydraulic force on the impeller is produced, and this force moves the impeller with the rotor in the axial direction counter to the arising magnetic restoring force, out of the centered position in the stator. If the hydraulic force falls away again, the rotor with the impeller is moved back again in the axial direction into its initial position by way of the mentioned magnetic restoring force. I.e. here one can produce a magnetic actuating and/or holding force which acts on the rotor and this on the impeller in the axial direction, without additional magnetic elements or other holding or actuation elements in the pump assembly becoming necessary. One could also apply a spring force produced by a spring element in order to hold the impeller in the desired position, instead of the described magnetic restoring force. The pump assembly could also be designed such that a spring force and a magnetic force hold the impeller in one of the positions in the previously described manner.

Further preferably, the pump assembly is designed such that the impeller in its first position is arranged in a manner such that it delivers into a first exit channel, and the impeller in its second position is arranged in a manner such that it delivers into a second exit channel. I.e. the impeller, when it is moved between the first and the second position, is moved between the two mentioned exit channels, wherein preferably in both positions it remains in connection with one and the same inlet channel. I.e. here the switch-over between two flow paths is effected by way of the exit, into which the impeller delivers, being changed by way of axial movement of the impeller.

Vice versa or additionally, according to a further possible embodiment of the invention, it is possible for the impeller in its first position to be arranged in a manner such that it is connected at a suction side to a first inlet channel, and the impeller in its second position is arranged such that it is connected at a suction side to a second inlet channel. According to a preferred design, the impeller thereby remains in fluid leading connection with the same outlet channel in both positions. I.e. the impeller delivers into the same outlet or exit channel in both positions, but however in the first position sucks through a different entry channel than in the second position. With this embodiment, a switch-over between the two flow paths is achieved in this manner by way of the impeller being brought into fluid-leading connection with two different entry channels.

It is to be understood that both embodiments could also be combined with one another, i.e. on movement of the impeller, the connection to the entry channel as well as the connection to the exit channel can be changed. Thus, for example, a switch-over of the delivery between two separate circuits is possible.

According to a particularly preferred embodiment of the invention, the pump assembly is designed in a manner such that the hydraulic force can be produced by way of a certain operating manner of the drive motor, in particular by way of a speed change. Thus, for example, by way of increasing the speed, the exit-side pressure of the fluid can be increased such that the pressure acting on the pressure surface mentioned above increases to such an extent that a counter-acting force, in particular the magnetic force described above, is overcome and the impeller is then pushed in the axial direction into another position. Thus, the delivery path through the pump assembly can be changed by way of a speed change of the pump assembly due to the impeller axially displacing on account of the changing fluid pressures. A valve could also be opened by way of a speed increase and pressure increase, by which means a pressure surface is impinged by the hydraulic pressure.

According to a further possible embodiment, the pump assembly can be designed in a manner such that the hydraulic force, by way of which the impeller is axially displaced, is produced by differently large accelerations of the drive motor. Differently great accelerations of the drive motor can lead to a different pressure built-up in conduit systems connecting to the pump assembly, so that different pressures can act on the impeller itself or on pressure surfaces which are connected or coupled in a force-transmitting manner to the impeller, for example via the rotor shaft. Thus, for example, two opposite pressure surfaces, e.g. at opposite axial sides of the impeller can be provided, which both are impinged with fluid pressure produced by the impeller, but via a connecting conduit system. The impeller can then be pushed into the respective direction by the higher hydraulic force, depending on which of the two pressure surfaces a greater pressure first builds up. Then, by way of a suitable design of the pump assembly, one can prevent a force counteracting the displacement from being produced on the other side. This can be effected for example by way of a flow path being closed or however by way of an interaction or support by way of a magnetic force counteracting this, as described above.

If the switching or change between the two flow paths is achieved by way of displacement of the impeller by way of different operating conditions of the drive motor, these operating conditions are preferably assigned to the flow paths, such that in the case that one of the operating conditions entails a worse efficiency, this operating condition is assigned to that flow path which is used more seldomly. This, for example, could be the flow path, through which heating medium is led into a heat exchanger for service water heating, since it is the service water heating which is usually demanded to a lesser extent than the heating of connecting room heating circuits.

The pump assembly is particularly preferably designed as a bistable system, in which the impeller on operation is held in a stable manner in each case in its first position and second position by way of the acting hydraulic and/or magnetic forces and/or spring forces, in particular by such forces as have been described previously. This means that if on operation the impeller has once reached one of the two positions, it remains in this position on operation. For moving into the other position, either an external force is to be mustered or the operating condition of the pump assembly is to be changed so that a switch-over force displacing the impeller into the respective other position is produced. The pump assembly particularly preferably can be designed such that only on starting up, i.e. on accelerating the drive motor from standstill can it effect a movement of the impeller from one into the other position. Thus, the pump assembly as described above can be designed such that the impeller in the idle condition is held in one of the positions by way of a magnetic force and/or a spring force. Moreover, the pump assembly can be designed such that a pressure acting on a pressure surface used for force production in the axial direction can be built up differently quickly due to the flow resistances of the connecting conduit systems or hydraulic components. If only two opposite pressure surfaces are present and both are impinged with the same hydraulic pressure, then there is no force which acts on the impeller in the axial direction and could for example displace this against a magnetic force or spring force. If however a pressure builds up more quickly on one of the pressure surfaces than on the other due to a particularly rapid acceleration of the impeller for example, a resulting axial force arises and this can be used for displacing the impeller into the other position. With the mentioned bistable construction, the impeller then remains in this position on operation. This can be achieved for example by way of a valve function of an element moving with the impeller, by way of which element one prevents the opposite pressure surface being impinged by pressure.

Preferably, the impeller in its first position is situated axially closer to the stator of the drive motor than in its second position. I.e. it is displaced out of its first position in the axial direction away from the stator into the second position.

Further preferably, the pump assembly is designed such that in the first position of the impeller, a hydraulic force acting in the direction of the first position acts on a suction-side axial face side of the impeller or of a pressure element or onto a pressure surface which is coupled to the impeller in a force-transmitting manner. I.e. the hydraulic force in the first position has the effect that the impeller is pressed into the first position. For this, the fluid pressure acts on the mentioned axial face side of the impeller or of a pressure element.

The pump assembly can moreover be preferably designed such that in the first position of the impeller a magnetic force and/or spring force acts in the direction of the first position on the impeller. This, for example, can be a magnetic force which, as described above, results from an axial shift between the rotor and stator, i.e. when the rotor with the impeller is moved out of this position, a magnetic restoring force arises between the rotor and stator and this force pushes or pulls the rotor into the first position. Alternatively or additionally, a spring element for producing a spring force could be present. Such a magnetic force and/or spring force in particular can serve for holding the impeller in a first position in a defined manner at standstill of the pump assembly, so that the impeller always starts from the first position.

According to a further preferred embodiment, the pump assembly is designed in a manner such that at least in the second position of the impeller, a hydraulic force acting in the direction of the second position acts on a pressure-side, axial face side of the impeller or on a side of the pressure element which is away from the second position or on a pressure surface which is away from the second position and is coupled in a force-transmitting manner to the impeller. This hydraulic force can then be used to hold the impeller in the second position in operation, and in particular against a magnetic force and/or spring force as has been described previously.

Moreover, it is preferable that the pump assembly is designed such that a suction-side, axial face side of the impeller or the face side of a pressure element coupled to the impeller is pressure-relived in the second position of the impeller. The axial face side of the impeller at the suction side is particularly relieved in pressure when the lower exit pressure of the fluid flowing in the circuit back to the pump assembly is present here. The pressure reduction or the pressure loss can occur for example in a pipe conduit system connecting downstream to the pump assembly. Particularly preferably, the conduit systems connected to the flow paths have different throttle characteristics, so that the pressure build up in these systems takes its course differently quickly on starting up the impeller, so that the axial displacement of the impeller can be achieved by differently large accelerations. With a slower acceleration, a more uniform pressure build-up can be achieved in both flow paths, whereas with a greater acceleration, a quicker pressure build-up is achieved, in particular in the flow path with the lower throttle effect. Here, instead of using the backflow through the flow paths for controlling the hydraulic forces, it is also possible to provide one or more suitable control conduits, as the case may be with throttle elements, in the pump assembly.

Thus in the pump assembly, one can provide preferably at least one connection channel which connects a pressure region or pressure channel which are situated downstream of the impeller, to a side of the impeller or of a pressure element coupled to the impeller the force transmission, said side being away from the pressure region, in order to transmit a hydraulic pressure from the exit side of the impeller to the side of the impeller or of the pressure element, said latter mentioned side being away from the pressure region. Thus, a hydraulic force can be produced, which presses the impeller into one of the positions, in particular the first position or holds it in this position. Preferably, a control element, for example a switchable valve or a throttle location can be arranged in the connection channel, for the control of the throughput through the connection channel. The pressure build-up at the connected side of the impeller or of the pressure element can be prevented or delayed by way of such an element, in order to prevent the axial displacement of the impeller and for example to move the impeller into the second position, by way of a higher pressure being firstly built up at the opposite side of the impeller or of the pressure element.

Moreover, it is preferable for a receiving space to be present, into which a closed, suction-side axial face side of the impeller or a pressure element coupled to the impeller, such as a control disc, enters in at least one position of the impeller and which is designed in a manner such that preferably via a throttle location, it can be impinged by a hydraulic pressure produced by the impeller, for producing a hydraulic force. The throttle location can thereby be formed by a gap between a peripheral wall of the receiving space and the outer periphery of the axial face side of the impeller or of the pressure element. Moreover, a damping effect on entry of the face side or of the pressure element into the receiving space can be achieved via this gap or this throttle location. The impeller can be pressed into a position away from the receiving space and be held in this as the case maybe by way of the hydraulic pressure which is led into the receiving space and impinges the adjacent closed face side of the impeller or the face side of a pressure element coupled to the impeller.

The subject matter of the invention, apart from the previously described pump assembly is also a heating installation with such a pump assembly. I.e. the pump assembly acts in the heating installation which in the context of this invention is also to be understood as an air-conditioning installation, as a heating circulation pump assembly in order to circulate the heat transfer medium, in particular water, in the heating installation. The heating installation according to the invention thereby comprises at least two installation parts, on which a first installation part is connected to the first flow path of the pump assembly and the second installation part is connected to the second flow path of the pump assembly. With regard to the installation parts, it can be the case of a heat exchanger and pipe conduit systems which with the flow paths of the pump assembly form a circuit in each case. I.e. the first flow path of the pump assembly lies in a fluid circuit through the first installation part and the second flow path of the pump assembly lies in a fluid circuit through the second installation part, so that the impeller in its first position delivers fluid through the first installation part and in its second position delivers fluid through the second installation path. Thus, different installation parts of a heating system can be supplied with a heating medium or cooling medium by way of displacing the impeller from the first into the second position.

Preferably, with regard to the two installation parts, it is the case of at least two consumers or at least two heat sources. Two consumers can for example be two different heating circuits of a heating installation which heat different parts of a building. For example, a conventional boiler heated by fossil fuels and a solar-thermal installation can serve for example as different heat sources. The two flow paths through the pump assembly are then connected in each case to one of the heat sources or to a consumer via suitable pipe conduit systems, so that the heating medium or fluid, in particular water is delivered through these installation parts, depending on whether the impeller is located in the first or in the second position.

Particularly preferably, the first installation part is a room heating circuit and the second installation part is a heat exchanger for service water heating. Such a configuration is to be found for example with compact heating installations which are used for heating apartments and detached houses for example. With these, usually a heat producer in the form of a boiler heated with fossil fuel is provided and comprises a primary heat exchanger, in which a heating medium, in particular water is heated. This water is then selectively led through the radiators in the rooms to be heated, i.e. through a room heating circuit, or through a heat exchanger for heating service water. For this, as a rule, a circulation pump is provided and the switching between the room heating circuit and the heat exchanger for the service water heating is effected by way of a 3/2-way valve. If the circulation pump is replaced by a pump assembly as has been described previously, then one can make do without the 3/2-way valve in such an assembly, since the switching between the service water heating and the room heating can be effected by way of axial displacement of the impeller in the pump assembly. Thus, the impeller, when it is located in its first position, delivers through the first flow path in the pump assembly and thus through a connected first installation part, specifically the room heating circuit. If the impeller is located in its second position, it delivers the heating medium through the second flow path and thus through the heat exchanger for service water heating and which is connected to this second flow path. Thus the construction of a heating installation can be significantly simplified, since one can make do without an additional valve and the switching between the heating circuits is ideally effected solely by way of targeted activation of the drive motor of the pump assembly, for example by way of speed change or changing the acceleration on starting up.

Further preferably, the heating installation is designed in a manner such that a hydraulic pressure prevailing at a branching point between the first and the second installation part, in at least one of the positions of the impeller effects a hydraulic force which holds the impeller in this position. Thereby, the installation is preferably designed such that this hydraulic pressure is transmitted through that installation part, through which no flow is effected in this position of the impeller. Thus, the unused installation part can essentially be used as a control conduit for the controlling and holding pressure impingement of the impeller. I.e. here the pressure prevailing at the branching point is used to hold the impeller in one of its positions or to move it into the desired position.

The subject matter of the invention is moreover a boiler for a heating installation, as has been described beforehand. The boiler preferably comprises a pump assembly as has been describe beforehand. Moreover, it comprises a primary heat exchanger, in which the heating fluid is heated for example by way of a combustor for fossil fuels, preferably gas. Moreover, it is provided with a secondary heat exchanger for service water heating as well as with at least one connection for a room heating circuit. This connection for the room heating circuit comprises at least one connection for the feed and a connection for the return of the room heating circuit. The secondary heat exchanger and the connection for the room heating circuit, i.e. in particular its feed, are connected to the primary heat exchanger via a branching point. I.e. the heating circuit downstream of the primary heat exchanger branches at the branching point to the connection for the room heating circuit and to the secondary heat exchanger. The boiler is designed such that a hydraulic pressure prevailing at the branching point, in at least one of the positions of the impeller of the pump assembly effects a hydraulic force in this, said hydraulic force holding the impeller in this position. Thus, as has been described previously with regard to the heating installation, the hydraulic pressure in the branching point is used for the control or for holding the impeller in a desired position.

The subject matter of the invention is moreover an impeller for a centrifugal pump assembly. This impeller in particular can be applied in a centrifugal pump assembly as has been described beforehand, but could also be applied independently in another centrifugal pump assembly. The impeller comprises at least one exit opening and one entry opening. A feature essential to the invention is that the entry opening is not situated at the axial side but in a peripheral section of the impeller, i.e. is opened to the outer periphery or at the radial side. Such an impeller permits the valve function described above, but could not only be applied for closing the flow path, but for example also for changing or switching over between two possible flow paths or effecting a mixed function, by way of axial displacement.

Particularly preferably, this impeller according to the invention comprises a closed, suction-side axial face side, to which the peripheral section with the entry opening is adjacent. I.e. the fluid to be delivered essentially does not flow in the axial direction but in the radial direction through the entry opening into the impeller. The closed axial-side face side at the suction side of the impeller can simultaneously assume the function of a control disc, by way of different hydraulic forces acting on both sides of this face side, i.e. on the one hand on the inner side of the impeller and on the other hand on the remote outer side of the impeller. These hydraulic forces can be used for the axial positioning or displacement of the impeller, depending on which side of the impeller a greater force acts. The closed axial face side can be designed as one piece or of one part with the further parts of the impeller. However, it is also possible to design this closed side in the form of a separate disc which is fixed directly on a shaft of the motor as well as the impeller. Such a disc can be arranged axially distanced to the impeller, so that a gap forming the annular, radial-side entry opening remains between the disc and the suction-side axial end of the impeller. Thus, an impeller according to the invention and which comprises an entry opening open to the outer periphery can be created with a conventional impeller with an axial entry opening and an additional element.

According to a further preferred embodiment, the entry opening is designed as an annular opening extending over the whole periphery of the impeller. Thereby, as the case may be, webs can be formed in the opening in the axial direction and connect the peripheral edges delimiting the opening, to one another, in order to stabilize the structure of the impeller. Alternatively or additionally, for example a closed axial face side of the impeller can also be connected to the remaining parts of the impeller via the shaft or a connection element in the inside of the impeller, in order to ensure a connection past the annular opening. The described opening preferably has an area which corresponds to 50 to 150% of the cross-sectional area in the inside of the impeller in this region, wherein this cross-sectional area extends transversely to the longitudinal axis or rotation axis of the impeller. The opening of the impeller is preferably selected so large that flow speeds which are too high do not occur in this region.

Further preferably, the impeller at its suction side comprises an extended cylindrical section with a cross section which preferably has an outer area which corresponds to a magnitude of 50 to 150% of an inner cross section (transverse to the longitudinal axis of the impeller) in the inside of this section. The previously described annular or radially opened opening forming the entry opening of the impeller can lie in this cylindrical section. The cylindrical section of the impeller permits an axial movement of the impeller in a pump assembly, as has been described beforehand, wherein the entry region or the entry opening in every position of the impeller can be adequately sealed to the outside, in order to separate the pressure side and suction side of the impeller from one another in every position.

The invention is hereinafter described by way of example and by way of the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
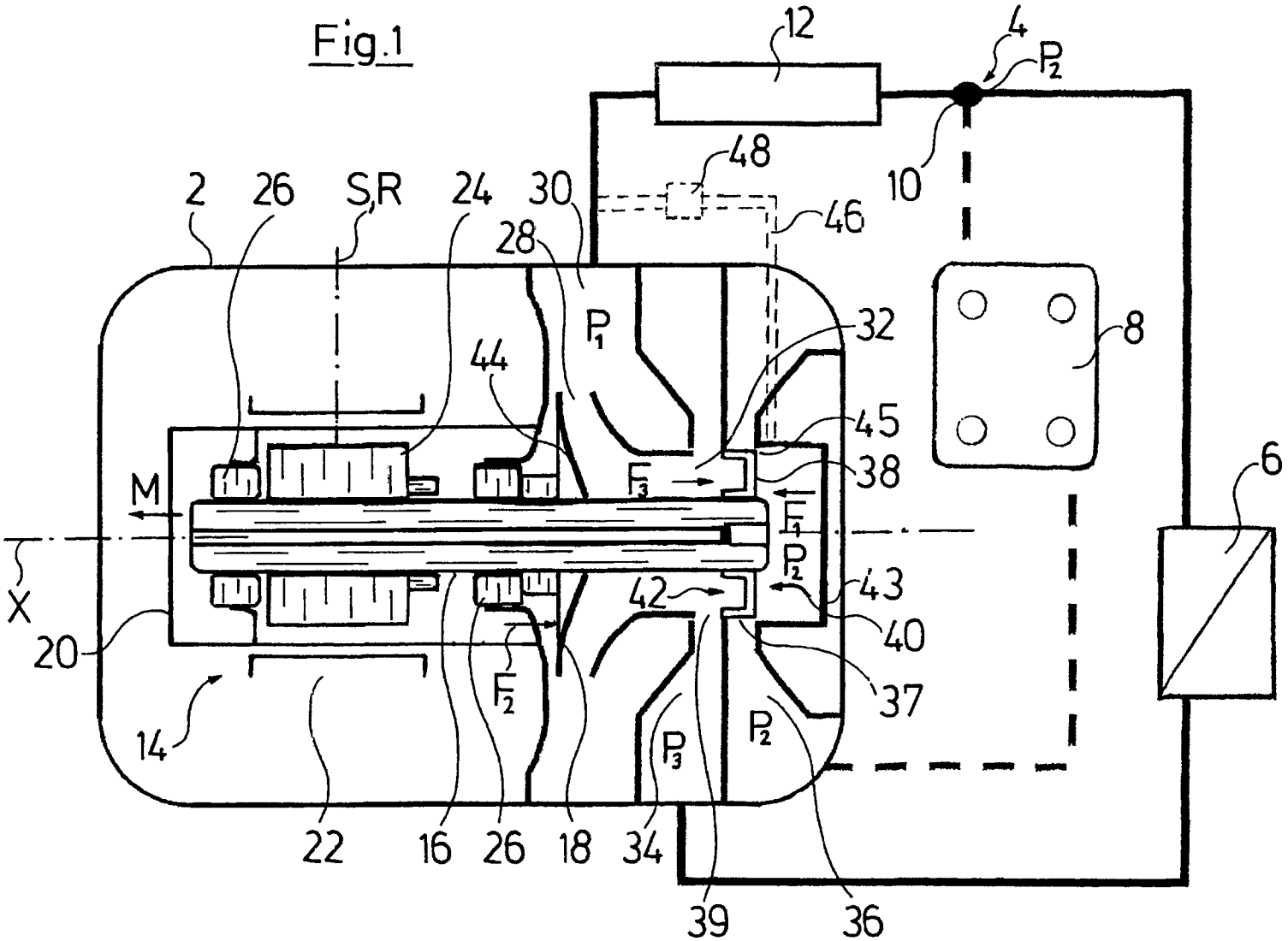
FIG. 1 is a schematic view of a pump assembly according to the invention with a connected heating installation, wherein the impeller of the pump assembly is located in a first position.
Figure 2:
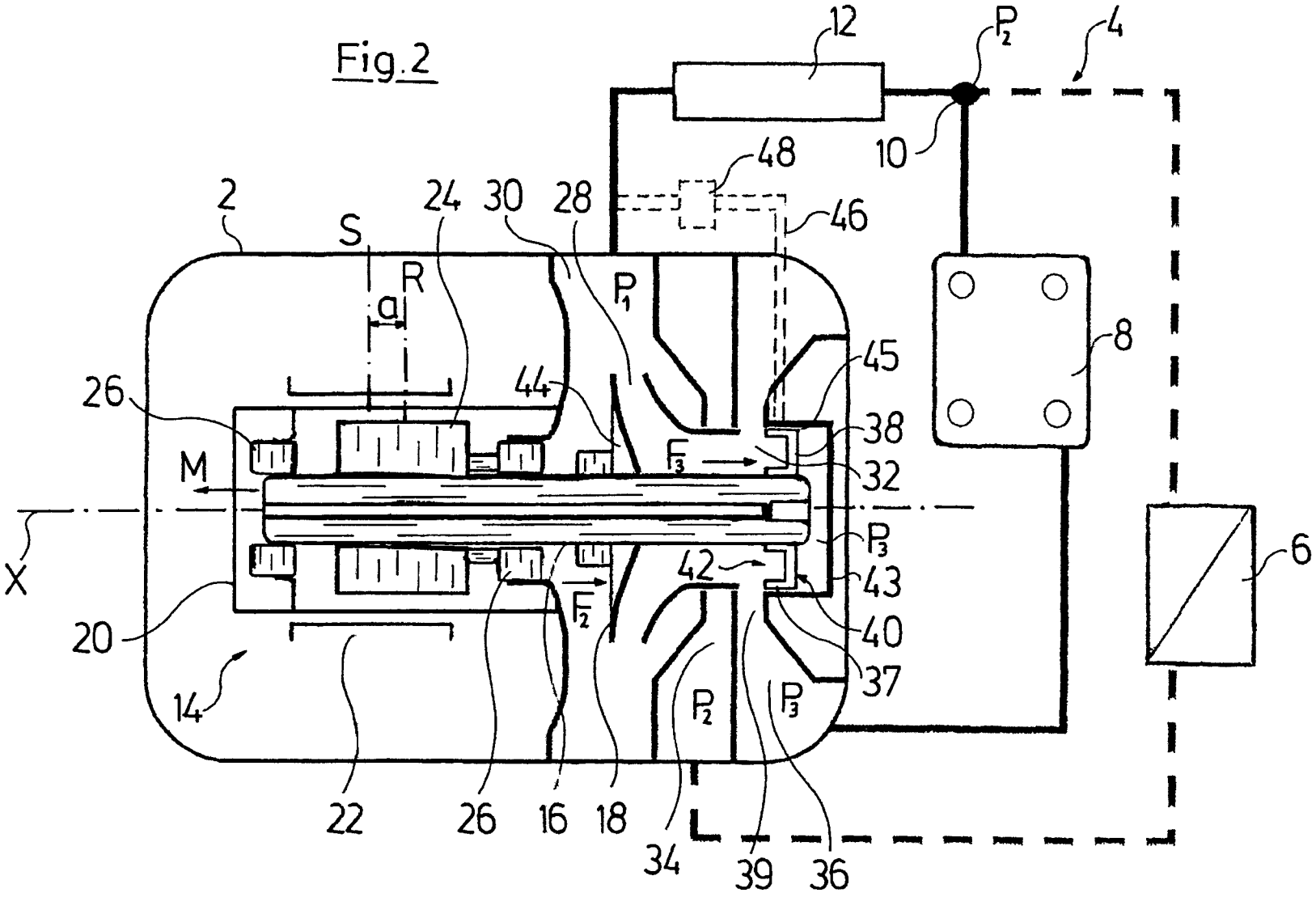
FIG. 2 is a schematic view of a pump assembly according to the invention and according to FIG. 1, with which the impeller is located in a second position.

A pump assembly 2 is represented schematically in the FIGS. 1 and 2, and is integrated into a heating installation 4, for example a compact heating installation. The heating installation 4 comprises a first installation part which is formed by a room heating circuit 6. A second installation part or heating circuit is formed by a heat exchanger 8 for heating service water. The first heating circuit through the room heating circuit 6 and the heating circuit through the heat exchanger 8 branch at a branching point 10 which is situated downstream of a primary heat exchanger 12. The primary heat exchanger 12 can be arranged in a gas boiler or oil boiler for example and serves for heating the heating medium, in particular water, in the heating installation 4, and this water then flows downstream through the heat exchanger 8 for the service water heating, which forms a secondary heat exchanger 8 and/or the room heating circuit 6. Hereby, the fluid which forms the heating medium is delivered by the pump assembly 2 through the primary heat exchanger 12 and the heating circuits.

The pump assembly 2 is a centrifugal pump assembly which comprises an electric drive motor 14 which via a shaft 16 drives an impeller 18 which is arranged on this in a rotationally fixed manner and in a manner fixed in the axial direction. The shaft 16 is preferably manufactured of ceramic and is machined to bearing quality over its complete length. The impeller is preferably manufactured of plastic. The drive motor 14 is designed as a wet-running electric motor which comprises a can 20 separating the stator 22 from the rotor space, in which the rotor 24 is arranged, in a fluid-tight manner. The rotor 24 is preferably designed as a permanent magnet rotor and likewise is fixed in an axially and rotationally fixed manner on the shaft 16. As the case may be, the rotor 24 could be designed as one piece with the shaft 16. The stator 22 which here is only shown schematically, can in the usual manner be formed of an iron part with stator coils arranged therein.

The shaft 16 is axially displaceable with the rotor 24 and the impeller 18 in the axial direction X in its bearings 26. By way of this, the impeller 18 is movable between a first position which is shown in FIG. 1, and a second position which is shown in FIG. 2. In its first position which is shown in FIG. 1, the impeller 18 is situated closer to the stator 22 than in its second position which is shown in FIG. 2.

The impeller 18 in the known manner comprises radially outwardly directed exit openings 28 which are open to a surrounding exit channel 30. The exit channel 30 in this example is connected to the entry side of the primary heat exchanger 12. I.e. the fluid exiting from the impeller 18 at the peripheral side is delivered through the exit channel 30 to the primary heat exchanger 12.

Moreover, the impeller 18 at an axial face side which is opposite to the exit openings 28 comprises an axially directed suction port 32. The suction port 32 depending on the axial position of the impeller 18 is selectively in fluid-leading connection with a first inlet channel 34 or a second inlet channel 36. I.e. in the first position of the impeller 18 which is shown in FIG. 1 this sucks fluid via its suction port 32 out of the first inlet channel 34. This first inlet channel 34 connects downstream to the room heating circuit 6 and thus forms a part of a first flow path for the heating medium through this room heating circuit 6. If the impeller 18 is located in the first position shown in FIG. 1, the fluid is thus delivered by the impeller 18 through the exit channel 30, the primary heat exchanger 12 via the branching point 10 through the room heating circuit 6 for the service water heating and back into the first inlet channel 34 and from there into the suction port 32.

If the impeller 18 is located in its axially displaced second position which is shown in FIG. 2, the suction port 32 to the second inlet channel 36 is opened, and this channel is connected to the exit side of the secondary heat exchanger 8 for the service water heating. In this position, with the drive of the impeller 18, fluid is delivered by the impeller 18 through the exit channel 30, the primary heat exchanger 12, via the branching point 10, through the secondary heat exchanger 8 and from there back into the second inlet channel 36, from which the suction port 32 sucks the fluid.

A pressure element in the form of a control disc 38 is fastened on the shaft 16, in a manner axially distanced to the suction port 32. This control disc is distanced to the suction port 32 in the axial direction in a manner such that a peripheral gap 39 is formed between the control disc 38 and the peripheral edge of the suction port 32, and this gap in the first position lies opposite the first inlet channel 34 and in the second position of the impeller lies opposite the second inlet channel 36. In the first position which is shown in FIG. 1, the control disc 38 with a peripheral wall 37 closes the second inlet channel 36, so that in this position, essentially no fluid can flow out of the second inlet channel 36 into the suction port 32 and thus essentially no fluid or heating medium is delivered through the secondary heat exchanger 8 in the first position shown in FIG. 1. In the second position shown in FIG. 2, a peripheral wall of the impeller 16 closes the first inlet channel 34 so that the impeller 32 essentially sucks no fluid out of the first inlet channel 34 and thus essentially no fluid or heating medium is delivered through the room heating circuit 6. The peripheral wall of the impeller 18 and the control disc 38 thus simultaneously have the function of valve. elements.

Thus a switch-over or change-over function between the room heating circuit 6 and the secondary heat exchanger 8 for service water heating and which is usually assumed by a 3/2 way valve in heating installations, can be achieved by the axial displacement of the impeller 16, and thus one can make do without such a valve. A simple branching at the branching point 10 is sufficient instead of such a valve. The construction of the heating installation is simplified in this manner.

According to the invention, the axial displacement of the shaft 16 with the impeller 18 is achieved without additional actuation elements solely by way of the operating manner of the electric drive motor 14. The impeller 18 in the idle position of the pump assembly is located in the first position shown in FIG. 1, i.e. in its position which in this case is situated closest to the stator 22. In this example, this is achieved by magnetic restoring forces M in the electric drive motor 14 which acts in the axial direction X. As is to be seen in FIG. 1, the rotor 24 is centered in the axial direction with respect to the stator 22, i.e. the axial middle S of the stator is congruent with the axial middle R of the rotor. In the axially displaced position shown in FIG. 2, the rotor 24 is displaced with respect to the stator 22 in the axial direction X, by an amount a, which is necessary for displacing the impeller 18 into the shown second position. I.e. here the axial middle R of the rotor is axially displaced by the amount a with respect to the axial middle S of the stator. The rotor 24 designed as a permanent magnet rotor however on account of its permanent magnetic forces, tends to center itself with respect to the stator 22 in the axial direction. This effects an axial restoring force M, i.e. an axially acting magnetic force which pulls the rotor 24 as well as the shaft 16 with the impeller 18 into the first position shown in FIG. 1 and holds it in this idle position.

If, departing from this idle position, the drive motor 14 is started up with a low acceleration, i.e. the speed in the temporal course is increased slowly, i.e. via a gentle gradient, this leads to a slow pressure build up in the exit channel 30 and in the flow paths which connect thereto downstream. Thereby, a pressure $p_1$ prevails in the exit channel 30. A pressure $p_2$ which is lower on account of the pressure loss in the primary heat exchanger 12 prevails at the branching point 10, downstream of the primary heat exchanger 12. Due to the pressure loss in the room heating circuit 6, the pressure in the heating circuit drops through the room heating circuit 6 in the further course, to the pressure $p_3$ prevailing in the first inlet channel 34, wherein the pressure $p_3$ forms the entry-side pressure at the impeller 18. Since essentially no fluid flow through the secondary heat exchanger 8 is effected in this condition, essentially the pressure $p_2$ likewise builds up in this, so that with a slow pressure build-up finally the pressure $p_2$ likewise prevails in the second inlet channel 36 as well as at the side 40 of the control disc 38 which is away from the impeller 18. This means a greater pressure $p_2$ prevails at the suction-side, side 40 of the control disc 38 which is away from the impeller, than in the first inlet channel 34, i.e. than the suction-side pressure of the impeller 18. An additional hydraulic axial force $F_1$ onto the control disc 38 is produced by way of this, and this force presses the control disc 38 together with the shaft 16 and the rotor 24 as well as the impeller 18 into the first position shown in FIG. 1 and holds it in this position. Simultaneously, a hydraulic force $F_2$ acts on a pressure-side shroud 44 of the impeller 18 on operation of the pump assembly. Thereby, such an interaction can be achieved between the hydraulic forces $F_1$ and $F_2$ as well as the magnetic restoring force M, by way of adapting the geometry of the control disc 38 in relation to the area of the rear-side shroud 44 and the design of the drive motor 14, that the magnetic restoring force M and the hydraulic axial force $F_1$ are greater than the hydraulic force $F_2$. Thus, in this operating condition, i.e. when the impeller 18 rotates by way of drive of the drive motor 14, the occurring hydraulic force $F_1$ pressing on the side 40 of the control disc 38 as well as the described magnetic restoring force M between the stator 22 and the rotor 24 keep the impeller 18 in this first position on operation. The impeller is maintained in the first axial position by a first acceleration.

Figure 3:
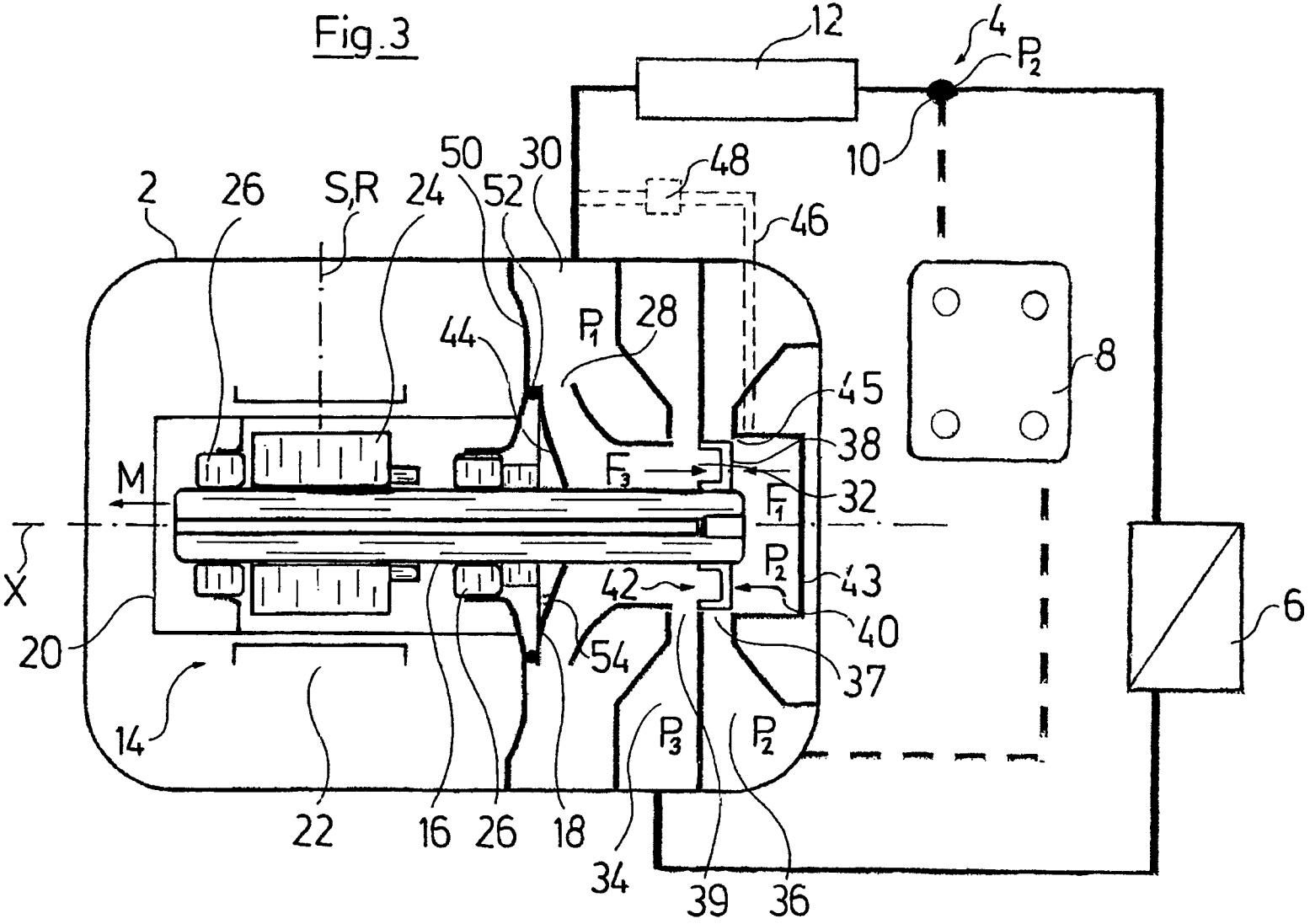
FIG. 3 is a schematic view of a pump assembly according to the invention, with a connected heating installation according to a second embodiment of the invention, wherein the impeller is located in the first position.

According to an alternative embodiment which is shown in FIG. 3, a seal 52 can be arranged between the pressure-side shroud 44 of the impeller 18 and an adjacent wall 50, and this seal prevents the pressure-side shroud 44 from being impinged by the pressure $p_1$ prevailing in the exit channel 30. Thus, the previously described hydraulic force $F_2$ is essentially eliminated, so that the impeller 18 can be held in the first position shown in the FIGS. 1 and 3 by the hydraulic force $F_1$. This can be additionally supported by the magnetic restoring force M.

The space in the inside of the seal 52 could moreover be subjected to a lower pressure from the inside of the impeller 18 via an optionally provided opening 54 which is drawn dashed in FIG. 3 and which is in the pressure-side shroud 44. Also several openings 54 could be provided instead of an opening 54. The preceding description as well as the subsequent description with regard to FIGS. 1 and 2 are referred to with respect to the further features of the second embodiment according to FIG. 3. Otherwise, the axial displacement of the impeller with the example shown in FIG. 3 is also effected in the manner explained previously and hereinafter.

If, proceeding from a standstill, in which the rotor 18 is located in the position shown in FIG. 1, the electric drive motor 14 is greatly accelerated, i.e. the speed in a temporal course is increased rapidly with a steep gradient, this then leads to a rapid pressure build up in the first heating circuit through the room heating circuit 6. If this circuit has a lower flow resistance than the secondary heat exchange 8, which as a rule is the case in such heating installations, then with a rapid start-up, initially a lower pressure will still prevail in the second inlet channel 36 than in the first inlet channel 34.

The control disc 38 is arranged such that with an axial displacement of the rotor 24 with the impeller 18, it immerses in the direction away from the drive motor 14 into a receiving space 43. The receiving space 43 in a plane transverse to the longitudinal or rotation axis X has a circular cross section whose inner diameter is slightly larger than the outer diameter of the control disc 38. Moreover, the receiving space 43 is designed in a pot-like manner and is only open at its side facing the impeller 18. In the first position of the impeller 18 which is shown in FIG. 1, the control disc 38 lies just outside the receiving space 43, so that the first side 40 of the control disc 38 which is away from the impeller, extends essentially in a plane with the peripheral edge at the axial end of the receiving space 43. Thus, an annular gap 45 is formed between this peripheral edge and the control disc 38. This gap forms a throttle for the fluid in the second inlet channel 36, so that a slower pressure built up is effected in the receiving space 43 than in the inlet channel 36. Thus, with a rapid start-up, a condition is achieved, in which firstly essentially no pressure is present at the first side 40 of the control disc 38 which is away from the impeller 18, whilst a pressure is built up at the opposite second side 42 of the control disc 38 which faces the impeller 18 and the suction port 32, and this pressure effects a force $F_3$ in the axial direction, which is greater than the described magnetic restoring force M and thus moves the rotor 18 from the first position shown in FIG. 1 into the second position shown in FIG. 2. Additionally, the hydraulic force $F_2$ acting on the pressure-side shroud 44 of the impeller 18 acts in the same direction as the hydraulic force $F_3$. In this condition, essentially the same pressure $p_2$ prevails in the first inlet channel 34 as at the branching point 10, since in this condition essentially no flow is effected anymore through the secondary heat exchanger 6. In contrast, the pressure through the room heating circuit 8 reduces so that then a lower pressure $p_3$, i.e. the suction-side pressure of the pump assembly prevails in the second inlet channel 36. This pressure then also prevails at the side 40 of the control disc 38 which is away from the impeller 18, so that no forces acts on this disc, which would seek to axially move the shaft 16 with the impeller 18. Finally, in this condition the same pressures, specifically the pressure $p_3$ then prevails at both sides 40 and 42 of the control disc 38. However, the pressure $p_1$ acts on the pressure side of the impeller 18, i.e. on the pressure-side shroud 44 of the impeller 18, and this pressure in this operating condition holds the impeller 18 in the second position shown in FIG. 2 by way of the resulting hydraulic force $F_2$, counter to the occurring magnetic restoring force M acting between the rotor 24 and the stator 22. The impeller is moved to the second axial position by a second acceleration.

As a whole, a bistable system is created, in which in the first operating condition, in which the impeller 18 is located in the first position shown in FIG. 1, this is held in this first position in a stable manner by way of the prevailing magnetic and hydraulic forces. If however due to a rapid start-up of the motor, one succeeds right at the beginning in the impeller relocating into its second position shown in FIG. 2, here then a second stable condition is achieved, in which the impeller remains in this second position as long as the drive motor is driven. On stopping the drive motor, the rotor 24 is automatically moved back into the first position by way of the magnetic restoring force M which comes from the axial shift of the stator 22 and rotor 24.

It is to be recognized that a switch-over between two flow paths can be achieved, specifically on the one hand between the flow path via the first inlet channel 34 and on the other hand the second flow via the second inlet channel 36, alone by way of the operating manner of the drive motor 14, specifically by way of the start-up behavior of the drive motor 14, without additional actuation elements or components being necessary for the axial displacement of the impeller 18.

With the example shown here, this behavior results from the different flow resistances of the secondary heat exchanger 8 and of the heating circuit 6. It is to be understood that an equal effect could also be achieved by way of an additional connection channel 46 as is drawn in FIGS. 1 and 2 in a dashed manner as an option. The connection channel 46 runs out at the peripheral wall of the receiving space 23 in a region which in the second position is covered and thus closed by the peripheral wall 37 of the control disc 38. With a slow start-up of the drive motor 14, a rapid pressure build-up in the receiving space 43 is achieved via the connection channel 46, so that a hydraulic force $F_1$ is built up very quickly there, which supports the magnetic force M, in order to hold the impeller 18 in the shown first position. In order to be able to succeed in a hydraulic force $F_3$ acting on the second side 42 of the control disc 38 which is away from the impeller being built up, so as to displace the impeller 18 into the second position shown in FIG. 7, a control element 48 for the control of the flow through the connection channel 46 and which can be designed as a simple throttle or as a switchable valve is arranged in the connection channel 46.

The connection channel 46 in particular is advantageous if the hydraulic resistance in the heating part upstream of the consumer, i.e. in particular in the primary heat exchanger 12 is very large. Thereby, the consumers form in this embodiment example the room heating circuit 6 and the secondary heat exchanger 8. If the hydraulic resistance in this heating part is very large, the pressure $p_2$ at the branching point 10 is too small, in order to exert a suitable hydraulic force $F_1$ on the impeller.

If the control element 48 is designed as a switchable valve, then the connection channel 46 can be closed, so that no hydraulic pressure $F_1$ can build up in the receiving space 43 and thus firstly a hydraulic force $F_3$ is built up via the first inlet channel 34 and this acts on the second side 42 of the control disc 38. This hydraulic force $F_3$ then leads to the axial displacement of the impeller 18 out of the position shown in FIG. 1 into the position shown in FIG. 2, wherein then additionally the control disc 38 with its peripheral wall 37 closes the connection channel 36. If the control element 48 is designed as a throttle, then by way of a suitable design of the throttle, one can ensure that with a rapid start-up of the drive motor from the first position shown in FIG. 1, a pressure $p_3$ is built up more quickly in the first inlet channel 34 via the room heating circuit 6 than a pressure $p_2$ in the receiving space 43 via the connection channel 46. Thus, the hydraulic force $F_3$ which acts on the second side of the control disc 38 will rise more rapidly and lead to the desired axial displacement of the control disc 38 together with the shaft 16 and the impeller 18. Instead of providing a separate control element in the form of a throttle, the cross section of the connection channel 46 can also be dimensioned such that an identical effect is achieved.

With the axial displacement of the control disc 38 from the first position shown in FIG. 1 into the second position shown in FIG. 2, with which the control disc 38 enters into the receiving space 43, the gap 45 at the outer periphery of the control disc 38 thereby effects a damping, since the fluid located in the receiving space 43 must exit out of the receiving space through this gap.

Instead of switching over by way of different accelerations of the drive motor, such a switching-over could also be effected alone by way of the speed change of the drive motor 14, by way of a respective constructive design. If the impeller 18 for example were to be arranged such that the pressure-side shroud 44 were to bear on a seal and the pressure-side shroud 44 could be subjected to pressure in a targeted manner, then an axial displacement of the impeller 18 could also be achieved by way of this pressure impingement. The pressure impingement could for example be effected via a valve which opens given a certain pressure in the exit channel 30, said pressure being achieved on reaching a certain speed of the drive motor 14, in order to then subject the pressure-side shroud 44 to pressure.

In the shown embodiment examples according to FIGS. 1 to 3, the control disc 38 could be an integral component of the impeller 18. Thus an impeller 18 is created, which has a closed, suction-side axial face side. This is formed by the control disc 38. The impeller then has a peripheral suction or entry opening which is formed by the gap 39. The gap 39 thereby preferably has an area which amounts to 50 to 150% of the cross-sectional area in the inside of the impeller 18 in the region of the gap 39. This inner cross-sectional area extends transversely to the longitudinal axis X. An adequately large flow cross section is ensured in this manner in the region of the gap 39. Moreover, one can recognize that such an impeller 18 in the region of the gap 39 has a cylindrical extension of a constant cross section which permits the axial displacement of the gap 39 between the inlet channels 34 and 36. The control disc 38 can be connected to the remaining parts of the impeller 18 via suitable webs or connection elements in the inside or however by way of the shaft 16 as is shown here.

Moreover, a suitable speed regulation of the drive motor 14 can be effected, in order to hold the impeller in the described positions, in particular in the first position shown in FIGS. 1 and 3, wherein by way of this speed regulation, it is ensured that a certain flow or a certain delivery output is not exceeded, at which the hydraulic force $F_2$ would rise to such an extent that an axial displacement of the impeller 18 would occur, which is not desirable in this situation.

The described magnetic restoring force M could moreover be supported or also replaced by a spring force. Thus, for example, a compression spring could be arranged in the receiving space 43, which exerts a pressure force produced in the axial direction X, onto the axial face end of the shaft 16 and this force presses the Shaft 16 with the rotor 24 and the impeller 18 into the first position shown in FIGS. 1 and 3.

Finally, the control disc 38 could also be designed as a stationary component, i.e. a component which does not rotate together with the shaft 16, and the shaft could come into sliding bearing contact on the control disc 38 merely at its face side. Thus, the control disc 38 despite this could yet exert an axial force which is directed in the direction of the hydraulic force $F_1$, onto the shaft. By way of a suitable positive engagement, the control disc 38 could moreover also transmit a hydraulic force $F_3$ onto the shaft 16 in the axial direction, without having to rotate together with this.

Moreover, it is to be understood that more than just the two shown possible operating positions of the impeller 18 could also be realized. In particular, the impeller 18 can also assume intermediate positions as the case may be, by which means a mixed function could be realized. Thus, such a pump assembly could also function as a mixer, e.g. for a floor heating circuit. Then, for example, the first inlet channel 34 would be connected to the heating water feed, whilst the second inlet channel 36 is connected to the return from the floor heating circuit, and the exit channel 30 is connected to the entry side of the floor heating circuit. A mixed function could then be achieved by way of the axial displacement of the impeller 18, since more or less fluid is delivered out of the heating water feed depending on the position, and accordingly a lower or higher share of fluid is delivered out of the return of the floor heating circuit. Such a defined displacement of the impeller 18 also into intermediate positions can be effected by way of a speed change of the drive motor with the pressure change entailed by this, or by way of additional actuation elements. For example, the stator 22 could be displaced in the axial direction X, in order to move the axial centre S of the stator and thus simultaneously to accordingly co-displace the rotor 24, which as described above, seeks to centre itself in the stator 22 in the axial direction.

Moreover, such a pump assembly, as has been previously described, instead of selectively serving two different heating circuits as installation parts of a heating installation, could also be used such that it selectively delivers fluid from two different heat sources or heat producers, for example a boiler heated by fossil fuel and a solar-thermal installation. In such a case, for example two different heat sources could be connected to the pump assembly 2 instead of the room heating circuit 6 and the secondary heat exchanger 8.

While specific embodiments of the invention have been shown and described in detail to illustrate the application of the principles of the invention, it will be understood that the invention may be embodied otherwise without departing from such principles.

The invention claimed is:

1. A pump assembly comprising:

an electric drive motor;

at least one impeller driven by the electric drive motor, wherein:

the at least one impeller is movable in an axial direction between at least one first axial position and a second axial position;

the at least one impeller in the first axial position is situated in a first flow path through the pump assembly and delivers fluid through the first flow path;

the at least one impeller in the second axial position is situated in a second flow path through the pump assembly and delivers a fluid through the second flow path;

the pump assembly is configured such that a movement of the at least one impeller between the first axial position and the second axial position at least in one direction is effected by a hydraulic force which acts on the at least one impeller and is produced by the delivered fluid;

the pump assembly is configured such that the hydraulic force can be produced by differently accelerations of the electric drive motor;

the at least one impeller is maintained in the at least one first axial position via a first acceleration;

the at least one impeller is moved to the second axial position via a second acceleration.

2. A pump assembly according to claim 1, wherein the pump assembly is configured such that the at least one impeller on operation is held in at least one of the positions by at least one hydraulic force produced by the delivered fluid.

3. A pump assembly according to claim 1, wherein the pump assembly is configured such that the at least one impeller on operation is held in at least one of the positions by way of an interaction of at least one hydraulic force produced by the delivered fluid, of a spring force or an axially acting magnetic force or any combination of the at least one hydraulic force, the spring force and the axially acting magnetic force, wherein the magnetic force acts on a rotor of the drive motor which is connected to the at least one impeller.

4. A pump assembly according to claim 1, wherein the at least one impeller is connected to a rotor of the electrical drive motor, and at least one magnetic force acting on the at least one impeller in the axial direction results from a magnetic interaction between the rotor and a surrounding stator from an axial shift between the rotor and the stator, the at least one impeller being maintained in the first position via the at least one magnetic force and the hydraulic force.

5. A pump assembly according to claim 1, wherein the at least one impeller in the first axial position is arranged such that the at least one impeller delivers into a first exit channel, and the at least one impeller in the second axial position is arranged such that the at least one impeller delivers into a second exit channel.

6. A pump assembly according to claim 1, wherein the at least one impeller in the first axial position is arranged such that the at least one impeller is connected at a suction side to a first inlet channel, and the at least one impeller in the second axial position is arranged such that at the suction side the at least one impeller is connected to a second inlet channel.

7. A pump assembly according to claim 1, wherein the pump assembly is configured such that the hydraulic force can be produced by the electric drive motor by way of a speed change.

8. A pump assembly according to claim 1, wherein the pump assembly is configured as a bistable system, in which the at least one impeller on operation is held in the first axial position or the second axial position by way of the acting hydraulic or magnetic forces or both the hydraulic and magnetic forces.

9. A pump assembly according to claim 1, wherein the at least one impeller in the first axial position is situated axially closer to the stator of the electric drive motor than in the second axial position.

10. A pump assembly according to claim 1, wherein the pump assembly is configured such that in the first axial position of the at least one impeller, a hydraulic force acting in a direction of the first axial position acts on a suction-side, axial face side of the at least one impeller or of a pressure element which is coupled to the at least one impeller in a force-transmitting manner.

11. A pump assembly according to claim 1, wherein the pump assembly is configured such that in the first position of the at least one impeller, a magnetic force acting in the direction of the first position acts on the at least one impeller.

12. A pump assembly according to claim 1, wherein the pump assembly is configured such that at least in the second position of the at least one impeller, a hydraulic force acting in the direction of the second axial position acts on a pressure-side, axial face side of the at least one impeller.

13. A pump assembly according to claim 12, wherein the pump assembly is configured such that in the second axial position of the at least one impeller, a suction-side axial face side of the at least one impeller or of a pressure element coupled to the at least one impeller is pressure-relieved.

14. A pump assembly according to claim 1, further comprising:

at least one connection channel which connects a pressure region situated downstream of the at least one impeller to a side of the at least one impeller or of a pressure element coupled to the at least one impeller for transmitting a hydraulic pressure, said side being away from the pressure region; and a control element configured to control the flow through the connection channel and arranged in the connection channel.

15. A pump assembly according to claim 1, further comprising a structure defining a receiving space into which a closed, suction-side axial face side of the at least one impeller or a pressure element coupled to the at least one impeller enters in at least one position of the at least one impeller and which is configured such that, via a throttle location, the receiving space is subjected to a hydraulic pressure produced by the at least one impeller, for producing a hydraulic force, wherein an annular gap is defined between a peripheral edge of the structure and the closed, suction-side axial face side of the at least one impeller or the pressure element and the closed, suction-side axial face side of the at least one impeller or the pressure element is located at a position outside of the receiving space when the at least one impeller is in the first axial position, at least a portion of a control disc being located in the receiving space when the at least one impeller is in the second axial position, wherein the receiving space is in fluid communication with an inlet channel of the pump assembly when the at least one impeller is in the second axial position and when the at least one impeller is in the first axial position.

16. A pump assembly according to claim 1, wherein the at least one impeller comprises at least one exit opening and at least one entry opening, wherein the entry opening is situated in a peripheral section of the at least one impeller.

17. A pump assembly according to claim 16, wherein the entry opening is configured as an annular opening extending over a whole periphery of the at least one impeller.

18. A pump assembly according to claim 16, wherein the at least one impeller at a suction side comprises an extended cylindrical section which has an outer area which is 50 to 150% of an inner cross section in the inside of this section.

19. A heating installation comprising:

a pump assembly comprising:

an electric drive motor;

at least one impeller driven by the electric drive motor, wherein:

the at least one impeller is movable in an axial direction between at least one first axial position and a second axial position;

the at least one impeller in the first axial position is situated in a first flow path through the pump assembly and delivers fluid through the first flow path;

the at least one impeller in the second axial position is situated in a second flow path through the pump assembly and delivers a fluid through the second flow path;

the at least one impeller is maintained in the at least one first axial position via a first acceleration;

the at least one impeller is moved to the second axial position via a second acceleration; and the pump assembly is configured such that a movement of the at least one impeller between the first axial position and the second axial position at least in one direction is effected by a hydraulic force which acts on the at least one impeller and is produced by the delivered fluid;

at least two installation parts, of which a first installation part is connected to the first flow path of the pump assembly, and a second installation part is connected to the second flow path of the pump assembly; and the pump assembly is configured such that the hydraulic force can be produced by differently accelerations of the drive motor.

20. A heating installation according to claim 19, wherein the at least two installation parts are at least two heat consumers or at least two heat sources.

21. A heating installation according to claim 19, wherein the first installation part is a heat exchanger for service water heating and the second installation part is a room heating circuit.

22. A heating installation according to claim 19, wherein the heating installation is configured such that a hydraulic pressure prevailing at a branching point between the first and the second installation part effects a hydraulic force in at least one of the positions of the at least one impeller which holds the at least one impeller in said at least one of the positions.

23. A heat installation according to claim 19, wherein the pump assembly further comprises a structure defining a receiving space, wherein a control disc is connected to the at least one impeller, wherein an annular gap is defined between a peripheral edge of the structure and the control disc and the control disc is located at a position outside of the receiving space when the at least one impeller is in the first axial position, at least a portion of the control disc being located in the receiving space when the at least one impeller is in the second axial position, wherein the receiving space is in fluid communication with an inlet channel of the pump assembly when the at least one impeller is in the second axial position and when the at least one impeller is in the first axial position.

24. A boiler comprising:

a pump assembly comprising:

an electric drive motor;

at least one impeller driven by the electric drive motor, wherein:

the at least one impeller is movable in an axial direction between at least one first axial position and a second axial position;

the at least one impeller in the first axial position is situated in a first flow path through the pump assembly and delivers fluid through the first flow path;

the at least one impeller is maintained in the at least one first axial position via a first acceleration of the electric drive motor;

the at least one impeller is rotated in the at least one first axial position;

the at least one impeller in the second axial position is situated in a second flow path through the pump assembly and delivers a fluid through the second flow path;

the at least one impeller is moved to the second axial position via a second acceleration of the electric drive motor;

the at least one impeller is rotated in the at second axial position; and the pump assembly is configured such that a movement of the at least one impeller between the first axial position and the second axial position at least in one direction is effected by a hydraulic force which acts on the at least one impeller and is produced by the delivered fluid;

a primary heat exchanger;

a secondary heat exchanger for service water heating as well as at least one connection for a room heating circuit, wherein the secondary heat exchanger and the connection for the room heating circuit are connected via a branching point to the primary heat exchanger, and a hydraulic pressure prevailing at the branching point, in at least one of the positions of the at least one impeller effects a hydraulic force which holds the at least one impeller in the at least one of the positions, wherein the pump assembly is configured such that the hydraulic force can be produced by differently accelerations of the drive motor.

25. A pump assembly according to claim 16, wherein the at least one impeller further comprises a closed, suction-side, axial face side, to which the peripheral section with the entry opening is adjacent.

* * * * *